US011774139B2

(12) United States Patent
Miller et al.

(10) Patent No.: US 11,774,139 B2
(45) Date of Patent: Oct. 3, 2023

(54) AIR HANDLING APPARATUS FOR HVAC SYSTEMS

(71) Applicant: Miller Industries, LLC, Fenton, MI (US)

(72) Inventors: Matt Miller, Fenton, MI (US); Don Wood, Fenton, MI (US)

(73) Assignee: Miller Industries, LLC, Fenton, MI (US)

( * ) Notice: Subject to any disclaimer, the term of this patent is extended or adjusted under 35 U.S.C. 154(b) by 659 days.

(21) Appl. No.: 16/123,878

(22) Filed: Sep. 6, 2018

(65) Prior Publication Data

US 2019/0137139 A1 May 9, 2019

Related U.S. Application Data

(60) Provisional application No. 62/554,643, filed on Sep. 6, 2017.

(51) Int. Cl.

| | |
|---|---|
| ***F24H 3/06*** | (2022.01) |
| ***F24D 19/00*** | (2006.01) |
| ***F24H 9/02*** | (2006.01) |
| ***F24H 9/00*** | (2022.01) |
| ***F24H 9/1881*** | (2022.01) |
| ***F24F 13/14*** | (2006.01) |
| ***F24D 5/02*** | (2006.01) |
| *F24F 13/06* | (2006.01) |
| *F24F 13/02* | (2006.01) |

(52) U.S. Cl.

CPC ..... *F24H 3/065* (2013.01); *F24D 5/02* (2013.01); *F24D 19/0058* (2013.01); *F24D 19/0065* (2013.01); *F24F 13/14* (2013.01); *F24H 9/0073* (2013.01); *F24H 9/1881* (2013.01); *F24D 2200/04* (2013.01); *F24F 13/02* (2013.01); *F24F 13/06* (2013.01)

(58) Field of Classification Search

CPC .. F24H 3/06–067; F24H 9/0073; F24H 3/025; F24H 3/027; F24D 19/0058; F24D 5/02; F24F 13/14

USPC ..... 126/110 A, 110 AA, 110 R, 103

See application file for complete search history.

(56) References Cited

U.S. PATENT DOCUMENTS

| | | | | |
|---|---|---|---|---|
| 2,625,150 | A * | 1/1953 | Little | F24H 3/065 126/110 AA |
| 6,591,788 | B2 | 7/2003 | Hughes et al. | |
| 6,666,681 | B1 * | 12/2003 | Do | F24H 3/065 432/201 |
| 7,997,004 | B1 * | 8/2011 | Adrian | E04H 15/12 34/227 |
| 8,186,119 | B1 | 5/2012 | Huff et al. | |
| 8,282,452 | B2 | 10/2012 | Grigsby et al. | |
| 9,316,411 | B2 | 4/2016 | Sherrow et al. | |

(Continued)

*Primary Examiner* — Ko-Wei Lin

(74) *Attorney, Agent, or Firm* — Young Basile Hanlon & MacFarlane, P.C.

(57) ABSTRACT

An air handling apparatus for a HVAC system of a building. The air handling apparatus includes an enclosure having at least one inlet opening for drawing outside air into the enclosure, and at least one outlet opening for directing air from within the enclosure to outside the enclosure. At least one fan is mounted within the enclosure for drawing air through the enclosure. A burner box is centrally located within the enclosure for heating outside air drawn into the enclosure through the at least one inlet opening.

18 Claims, 6 Drawing Sheets

(56) References Cited

U.S. PATENT DOCUMENTS

| | | | | |
|---|---|---|---|---|
| 9,416,997 | B1 | 8/2016 | Bush, Jr. et al. | |
| 2004/0103892 | A1* | 6/2004 | Shimonoma | F24H 3/04 126/110 B |
| 2005/0036770 | A1* | 2/2005 | Ito | F24H 3/04 392/307 |
| 2010/0024794 | A1* | 2/2010 | Desi-Seulean | F23D 14/20 126/110 B |
| 2010/0112930 | A1* | 5/2010 | Grigsby | F24F 3/0442 454/333 |
| 2011/0034119 | A1* | 2/2011 | Mase | B24C 9/00 451/88 |
| 2016/0018131 | A1* | 1/2016 | Meso | F23M 9/06 126/90 R |

* cited by examiner

AIR HANDLING APPARATUS FOR HVAC SYSTEMS

CROSS-REFERENCE TO RELATED APPLICATION

This application claims the benefit of U.S. Provisional Application Ser. No. 62/554,643, filed on Sep. 6, 2017, the entire disclosure of which is incorporated herein by reference.

TECHNICAL FIELD

This disclosure relates to enclosures for HVAC systems, and particularly to an enclosure having one or more heating elements or burner boxes positioned between the floor and the roof of such enclosure to provide for easier access to the heating elements or burner boxes and improve the air flow through the enclosure.

BACKGROUND

Large buildings such as factories, warehouses, hospitals, schools, arenas and the like require HVAC systems to heat and cool the air in the structure. The equipment is usually placed outside the building, either at ground level or on the roof of the structure. Accordingly, air intakes must be designed to block the inflow of precipitation, such as rain or snow, while still allowing air to enter the enclosure. Likewise, sufficient airflow must be maintained around the heating and cooling elements contained within the enclosure.

A general configuration of such structures may be seen in U.S. Pat. No. 8,186,119, issued to Huff et al, which depicts, in general terms, the type of HVAC enclosure utilized to enclose and protect the operating elements of the HVAC system. As above referenced, these enclosures are often roof mounted, or positioned at some height above the ground. Many such enclosures are several feet in height and pose a risk of injury from maintenance personnel falling from the top of such enclosures.

As shown in attached prior art FIGS. 3-4, it is common to construct HVAC enclosures of steel and aluminum, in a generally box-like configuration. An air handling section extends from one end of the enclosure to an opposite end. Proximate at each end of the enclosure is an array of electrically powered fans which move air from an intake section, through a gas-fired burner box, and then through air discharge sections wherein the heated air is directed into the building on which the enclosure is positioned. A service access corridor is positioned adjacent and parallel to the air handling section, and the service access corridor has a pedestrian entry door to facilitate access to the interior of the enclosure for maintenance purposes. Additional doors interconnect the air handling sections and service access corridor, providing access between the various air handling sections.

In such prior art designs, the air intake is mounted to the roof of the structure, and the burner box is interposed between the air intake and roof of the enclosure. Accordingly, service of the air intake and the burner box requires working from the roof of the structure. Further, the amount of airflow available to the interior of the unit is a function of the dimensions of the air intake structure. If the dimensions of the air intake structure are limited, the force and velocity of the incoming air through the air intake structure may be increased which may pull in snow or rain into the enclosure thereby affecting the performance of the HVAC system.

Additionally, the enclosure must be designed with sufficient strength for the roof to support both the air intake and the burner box which may increase the cost of the enclosure. Such a structure also requires the air intake structure and burner box to be built and shipped as modules which increases the costs of shipping and assembling the enclosure.

SUMMARY

The present disclosure relates an air handling apparatus for a HVAC system for a building. The air handling apparatus includes an enclosure having at least one inlet opening for drawing outside air into the enclosure, and at least one outlet opening for directing air from within the enclosure to outside the enclosure. At least one fan is located within the enclosure for drawing air through the enclosure. A burner box is mounted within the enclosure for heating outside air drawn into the enclosure through the at least one inlet opening and may be centrally located within the enclosure.

The enclosure may include a pair of side walls, a pair of end walls, a roof, and a floor. The burner box may be positioned between the roof and floor of the enclosure. The at least one inlet opening may be formed in the roof or side walls of the enclosure. Downwardly extending louvers may be formed within the at least one inlet opening. The floor of the enclosure may be formed from an open grate material which creates a floor air inlet for allowing outside air to flow into the enclosure.

The at least one outlet may be formed in the end walls of the enclosure. A duct system may be in communication with the at least one outlet to direct air from within the enclosure to a predetermined location.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
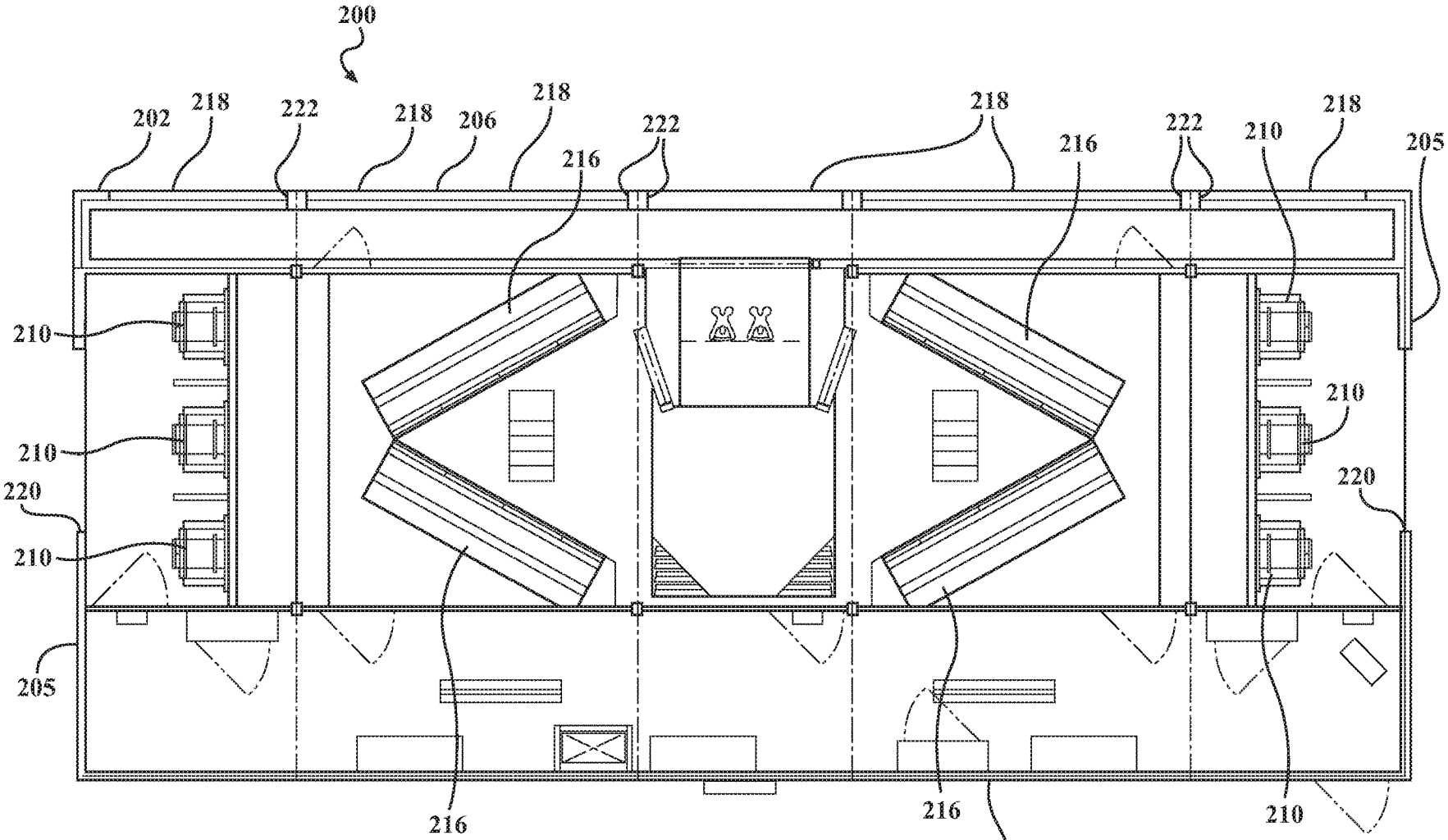
FIG. 1 is a plan view of an enclosure of an air handling apparatus for an HVAC system.
Figure 2:
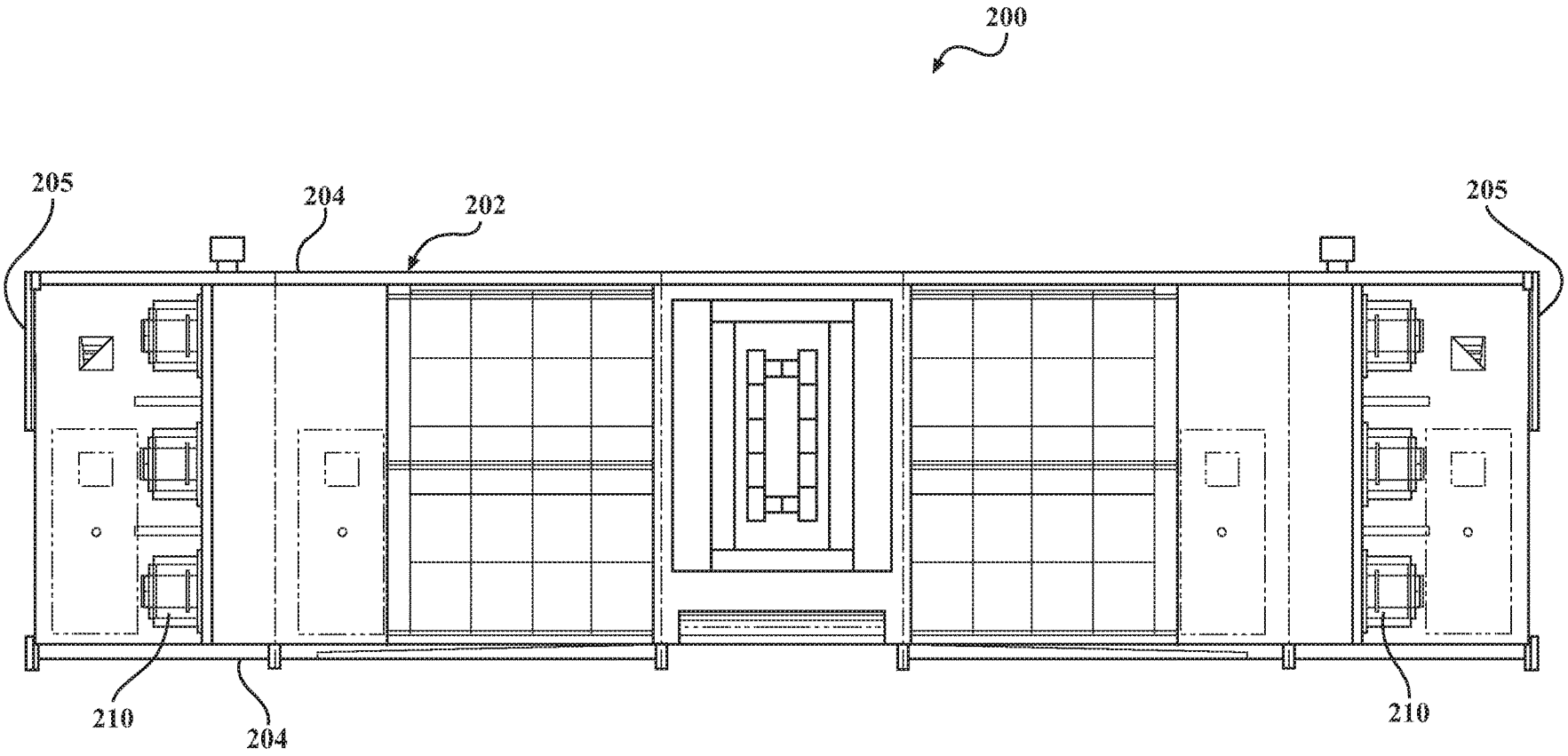
FIG. 2 is a front elevation of the enclosure of an air handling apparatus for an HVAC system.
Figure 3:
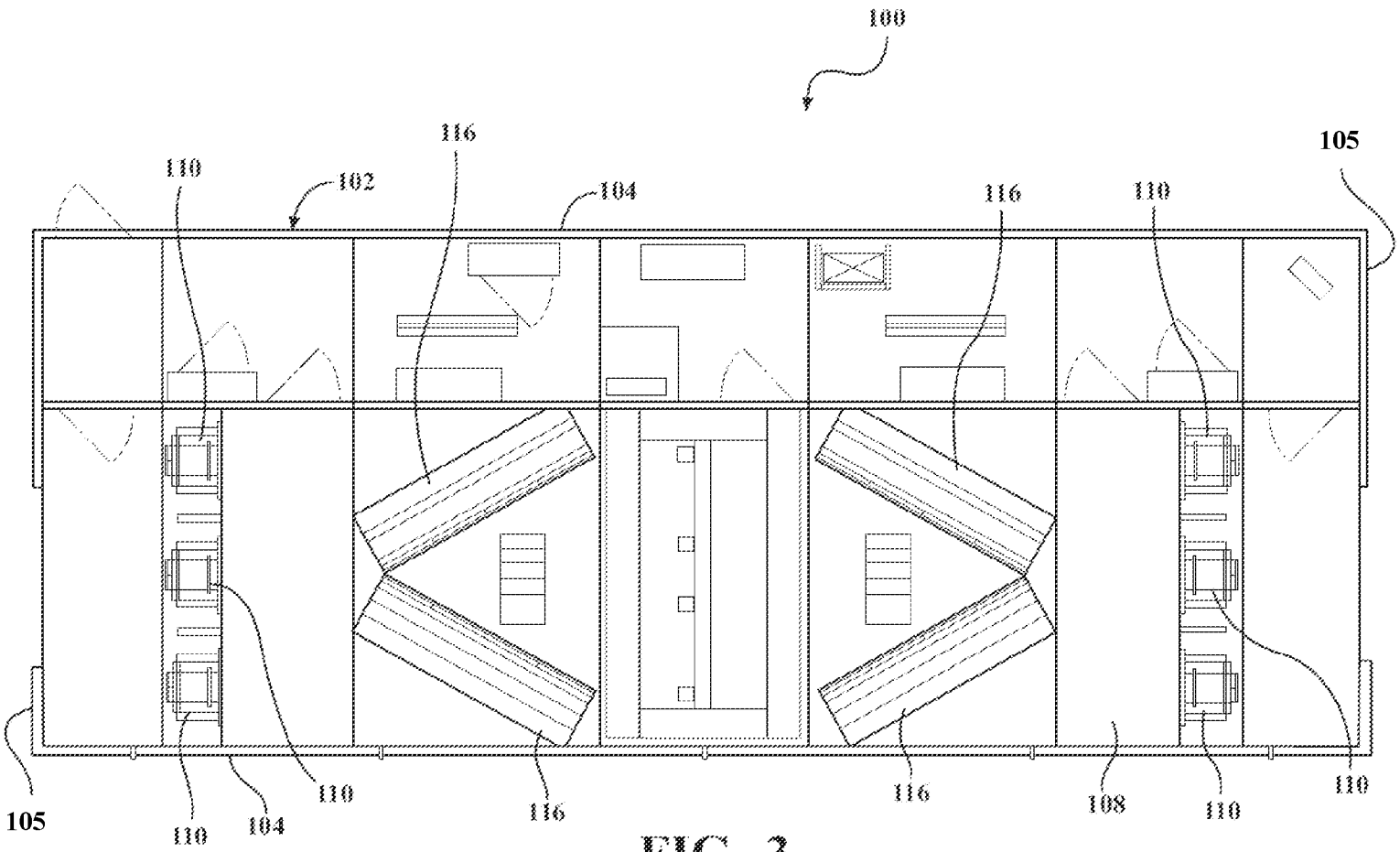
FIG. 3 PRIOR ART
FIG. 3 is a plan view of a prior art HVAC enclosure.
Figure 4:
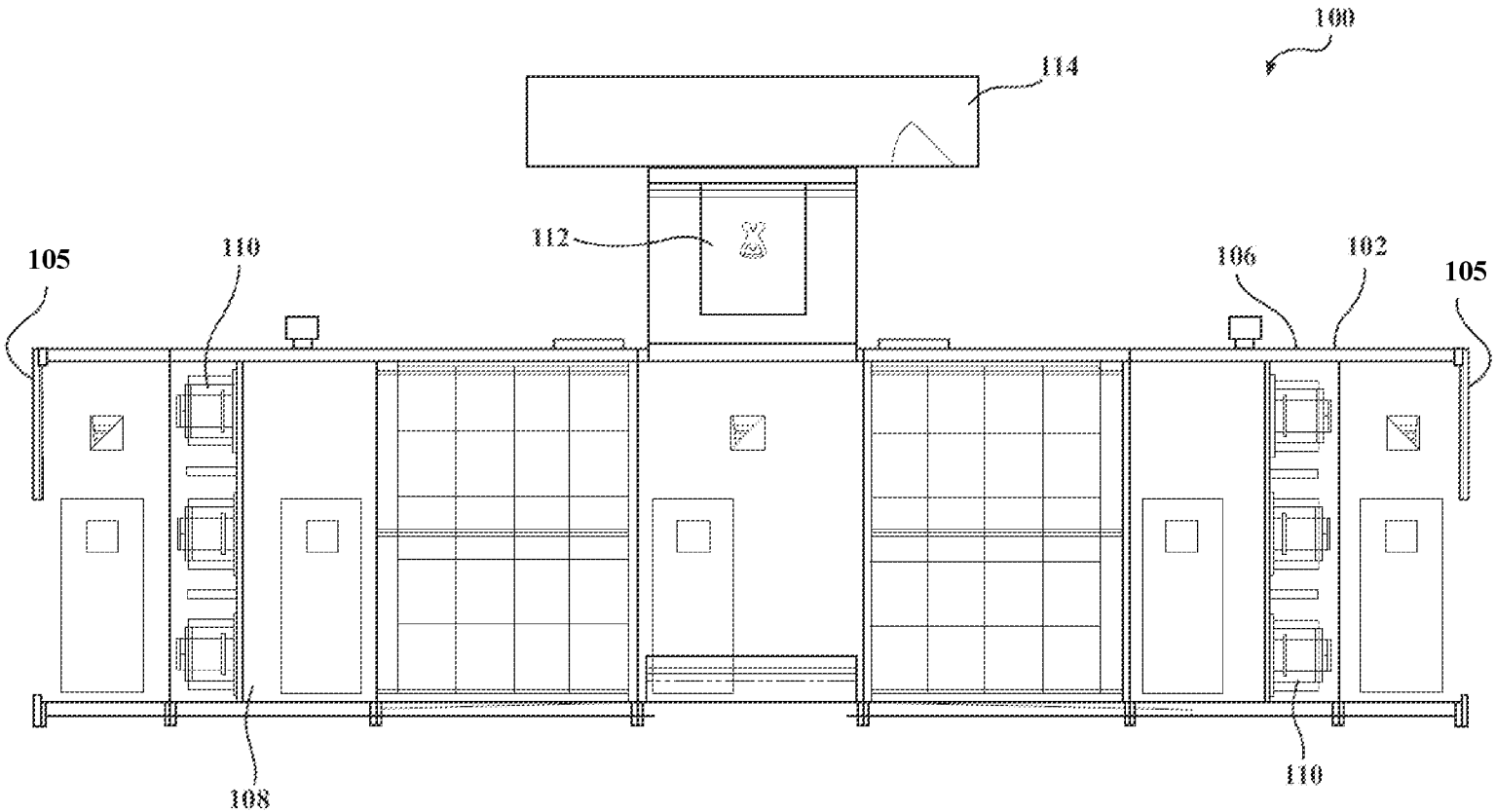
FIG. 4 PRIOR ART
FIG. 4 is a front elevation of a prior art HVAC enclosure.
Figure 5:
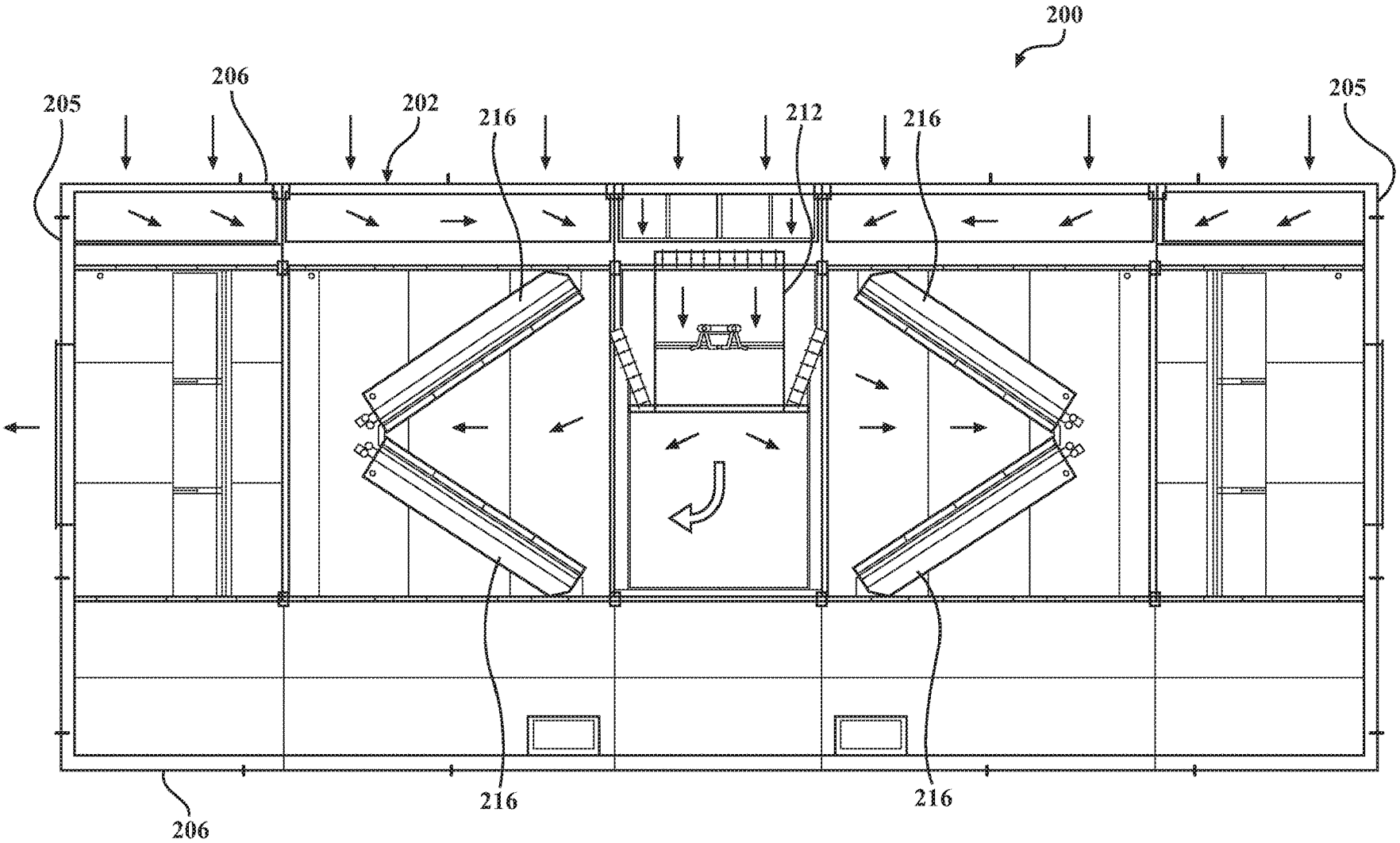
FIG. 5 is an enlarged plan view of the enclosure of an air handling apparatus for an HVAC system.
Figure 6:
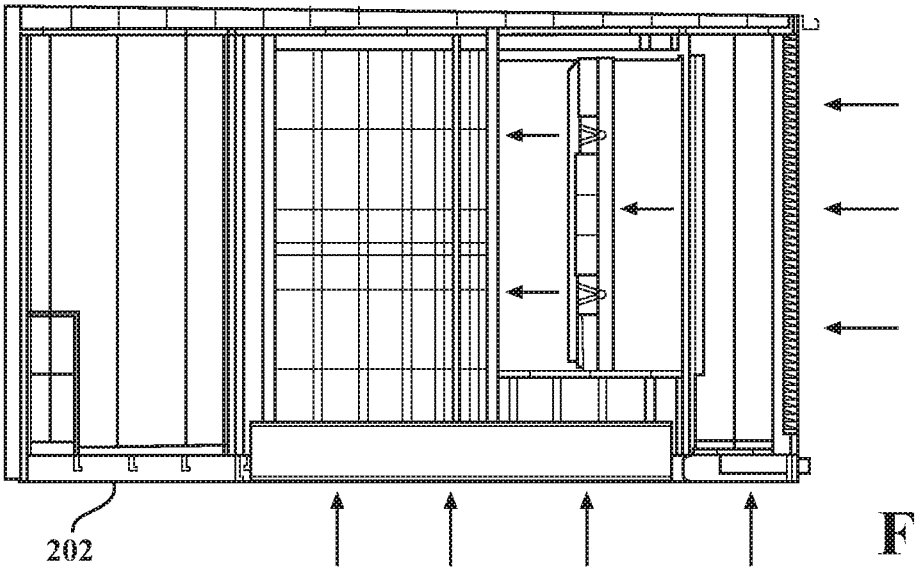
FIG. 6 is a side elevation of the enclosure of an air handling apparatus for an HVAC system.
Figure 7:
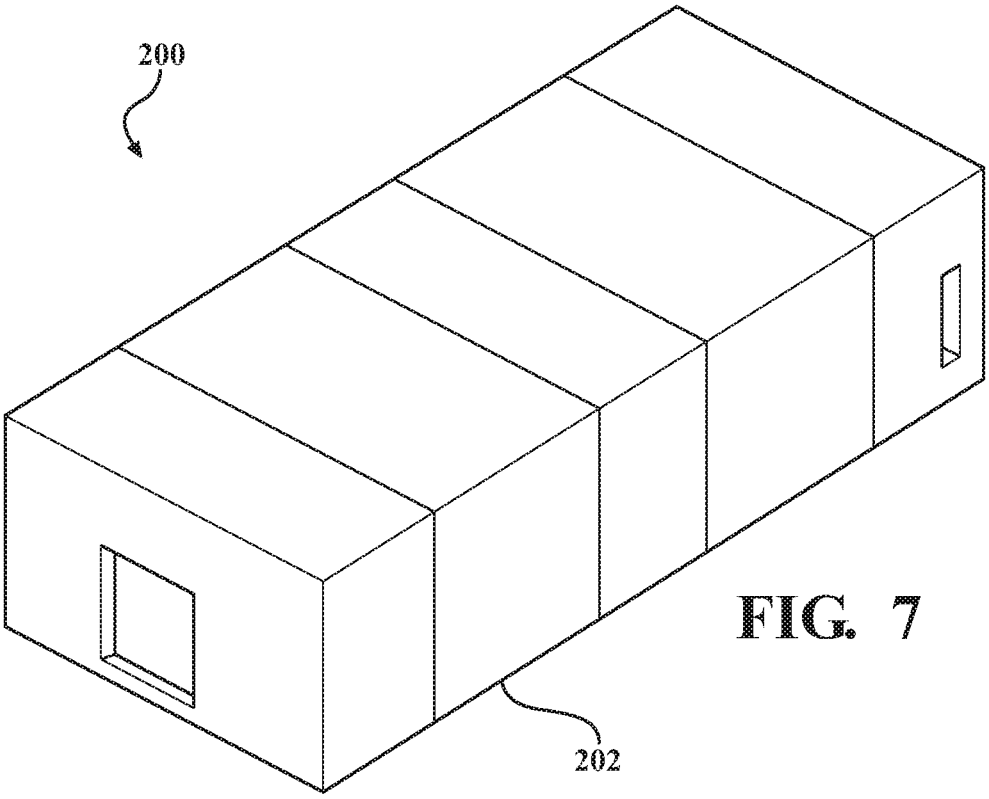
FIG. 7 is a perspective and transparent view of the enclosure of an air handling apparatus for an HVAC system.

Initially, reference to the prior art device shown in FIGS. 3 and 4 will facilitate an understanding of the problems solved by the present disclosure. As seen in FIGS. 3 and 4, the prior art discloses an HVAC system 100 having a six-sided enclosure 102 which is essentially rectangular in cross section and provides the basic structure of the HVAC system 100. The six sides of the enclosure 102 include a pair of opposing side walls 104, a pair of opposing end walls 105, a roof 106, and a floor 108. Typically, the side walls 104, the end walls 105, the roof 106, and the floor 108 of the enclosure 102 are rigid, incorporating a steel framework and a metal skin, preferably aluminum, desirable for its light weight, high strength, ease of fabrication and low cost. Inside the enclosure 102 is at least one plenum section through which outside air is directed by at least one motor driven fan 110. In the prior art, a burner box 112 is mounted to the roof 106 of the enclosure 102. Intake air enters from an intake hood 114 and passes into the burner box 112, wherein an array of burner nozzles (not shown) are fed by a source of fuel (not shown), such as natural gas. An igniter (not shown) serves to initiate and maintain flames at the burner nozzles, maintaining a high temperature within the burner box 112 and heating the intake air. The heated intake air passes through the plenum and openings in the walls 104 where the heating air is directed into the interior of a building (not shown).

As seen in FIGS. 3 and 4, it is also known to include air conditioning evaporator coils 116 within the enclosure 102 to provide cool air to the building. The air conditioning evaporator coils 116 are associated with a separate compressor (not shown) external to the enclosure 102, thereby providing a source of refrigerated air to the building in a fashion well-known to those skilled in the art.

As seen in FIGS. 1-2 and 4-7, a HVAC system 200 of the present disclosure provides an enclosure 202 similar to the enclosure 102 described in the prior art. That is, the enclosure 202 has a six-sided rectangular structure having a pair of opposing side walls 204, a pair of opposing end walls 205, a roof 206, and a floor 208. The side walls 204, the end walls 205, the roof 206, and the floor 208 of the enclosure 202 are also rigid by incorporating a steel framework and a metal skin, preferably aluminum which provides for a light weight, high strength, low cost enclosure 202 that is relatively easy to fabricate. The enclosure 202 also provides at least one plenum section through which outside air is pulled in through openings in the enclosure 202 and directed through the enclosure 202 by at least one electrically driven fan 210. As a non-limiting example, an array of fans 210 formed in three rows of three on each end of the enclosure makes for a total of 18 fans 210. The fans 210 are positioned to draw air in from the plenum or inner, center portion of the enclosure 202 and force the air toward the end walls 205 of the enclosure 202 wherein an outlet opening 220 in each of the end walls 205 of the enclosure 202 may be in communication with a duct system (not shown) that directs the air toward the interior of the building.

Air conditioning evaporator coils 216 may also be provided within the enclosure 202 to provide cool air to the building. The air conditioning evaporator coils 216 are associated with a separate compressor (not shown) external to the enclosure 202, thereby providing a source of refrigerated air to the building in a fashion well-known to those skilled in the art. As a non-limiting example, four sets of the air conditioning evaporator coils 216 may be provided within the enclosure 202 wherein two sets of the air conditioning evaporator coils 216 are mounted at an angle with respect to one another at each end of the enclosure 202. The two sets of air conditioning evaporator coils 216 mounted at an angle with respect to one another form a "V" shape wherein the open portion of the V-shape is open to the middle or center of the enclosure 202 to receive the flow of air which travels from the mid-section or plenum of the enclosure 202 toward the end walls 205 of the enclosure 202. This provides for proper heat transfer as the air is cooled when passing over the air conditioning evaporator coils 216.

The HVAC system 200 of the present invention is unique over the prior art in that a burner box 212 is centrally mounted within the six sides 204, 205, 206, 208 of the enclosure 202, and the burner box 212 is positioned at a working height in relation to the floor 208 of the enclosure 202. By having the burner box 212 mounted between the roof 206 and the floor 208 within the enclosure 202 as opposed to on the roof 106 of the enclosure, maintenance can be performed on the burner box 212 without having to climb onto the roof of the enclosure 202 thereby enhancing the safety of the maintenance worker. In addition, maintenance can be performed within the enclosure 202 by allowing access to the interior of the enclosure 202 through a door in the end walls 205 or side walls 204 of the enclosure 202 thereby protecting the maintenance worker from any harsh environmental conditions. The burner box 212 operates in the same manner as described in the prior art, that is, intake air is directed into the burner box 212 from openings 222 provided in the side walls 204 and/or the roof 206 of the enclosure 202, as will be described below. The burner box 212 is gas fired and heats the intake air as the intake air passes through the burner box 212. The heated air is then directed to the outlet openings in the end walls 205 via the fans 210.

In order to enhance air flow through the enclosure 202 and prevent precipitation from entering the enclosure 202, downwardly angled louvers 218 may be mounted within the inlet openings 222 extending along the roof 206 and/or the side walls 104 of the enclosure 202. By providing a sufficient number of inlet openings and louvers 218 along the side walls 204 and the roof 206 of the enclosure 202, the incoming air flows into the enclosure 202 at a lower force and velocity than provided in the prior art design, and thus, precipitation and/or snow are not pulled into the enclosure by the incoming air. In addition, the louvers are angle downward thereby directing and deflecting precipitation and/or snow from entering the enclosure 202 and affecting the performance of the HVAC system 200. At least a portion of the floor 208 of the enclosure 202 is formed of a rigid, open grate material which allows incoming outside air to flow through a floor air inlet formed in the grate material. The grate material in the floor 208 of the enclosure ensures for proper air flow into and through the enclosure 202 while ensuring that precipitation and/or snow cannot enter the interior of the enclosure 202.

In this fashion, the present disclosure presents a configuration which provides convenient service access to the burner box 212 and other internal components of the HVAC system 200, without the need for access to the roof 206 of the enclosure 202. The enclosure 202 of the HVAC system 200 is also lighter in weight than prior art devices and occupies a smaller footprint where installed. In addition, the present disclosure provides a simplified assembly which can be shipped to the job site in fewer sections, since the burner box 212 is contained within the enclosure and does not require a separate intake hood 114. The increased air intake dimensions over the prior art also permit a reduction in incoming air velocity while still providing sufficient volumes of air thereby prohibiting precipitation and/or snow from being pulled into the disclosure.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An air handling apparatus for a HVAC system, comprising:

a rectangular enclosure having a pair of side walls, a roof, and a floor with a plurality of inlet openings extending through the roof for drawing outside air into the enclosure, and at least one outlet opening for directing air from within the enclosure to outside the enclosure;

at least one fan within the enclosure for drawing air through the enclosure; and a burner box mounted within the enclosure for heating air within the enclosure, wherein the at least one fan is located between the burner box and the at least one outlet opening to draw air from the plurality of inlet openings, through the burner box, and out the at least one outlet opening, the enclosure including a pedestrian entry door and a service access corridor providing access to an interior of the enclosure to allow a maintenance worker to enter the enclosure and service the burner box such that the enclosure protects the maintenance worker from any harsh environmental conditions.

2. The air handling apparatus of claim 1, wherein the enclosure includes a pair of end walls.

3. The air handling apparatus of claim 1, wherein the burner box is positioned and spaced between the roof and the floor of the enclosure.

4. The air handling apparatus of claim 1, wherein downwardly extending louvers are mounted within the at least one of the plurality of inlet openings.

5. The air handling apparatus of claim 1, wherein downwardly extending louvers are mounted within the plurality of inlet openings.

6. The air handling apparatus of claim 1, wherein the floor has at least one section formed from an open grate material which creates an air inlet for allowing outside air to flow into the enclosure.

7. The air handling apparatus of claim 2, wherein the at least one outlet opening is formed in at least one of the pair of end walls of the enclosure.

8. The air handling apparatus of claim 7, wherein a duct system is in communication with the at least one outlet opening to direct air from within the enclosure to a predetermined location.

9. The air handling apparatus of claim 3, wherein the burner box is centrally located within the enclosure.

10. An air handling apparatus for a HVAC system of a building, comprising:

a rectangular enclosure having a pair of opposing side walls, a pair of opposing end walls, a roof, and a floor;

a plurality of inlet openings formed in the enclosure for drawing outside air into the enclosure, and at least one outlet opening for directing air from within the enclosure to outside the enclosure;

at least one fan mounted within opposing ends of the enclosure for drawing air through the enclosure;

a burner box centrally located within the enclosure between the roof and the floor of the enclosure for heating air within into the enclosure, wherein the at least one fan is located between the burner box and the at least one outlet opening to draw air from the plurality of inlet openings, through the burner box, and out the at least one outlet opening; and at least one air conditioning evaporator coil located within the enclosure and adjacent the burner box for cooling air drawn into the plurality of inlet openings and exiting the at least one outlet opening, wherein the enclosure includes a pedestrian entry door and a service access corridor providing access to an interior of the enclosure to allow a maintenance worker to enter the enclosure and service the burner box such that the enclosure protects the maintenance worker from any harsh environmental conditions.

11. The air handling apparatus of claim 10, wherein the plurality of inlet openings further include being is formed in at least one of the pair of side walls of the enclosure.

12. The apparatus of claim 10, wherein a downward louver is formed in the plurality of inlet openings.

13. The apparatus of claim 10, wherein the at least one outlet opening is formed in the pair of opposing end walls of the enclosure.

14. The apparatus of claim 10, wherein the floor has at least one section formed from an open grate material which creates an air inlet for allowing outside air to flow into the enclosure through the floor.

15. The air handling apparatus of claim 13, wherein a duct system is in communication with the at least one outlet opening to direct air from within the enclosure to a predetermined location.

16. An air handling apparatus for a HVAC system of a building, comprising:

an enclosure having a pair of opposing side walls, a pair of opposing end walls, a roof, and a floor;

a plurality of air inlet openings formed in at least one of the pair of opposing side walls and the roof of the enclosure for drawing outside air into the enclosure, and at least one air outlet opening formed in each of the pair of opposing end walls for directing air from within the enclosure to outside the enclosure;

the floor having at least one section formed from an open grate material which creates a floor air inlet for allowing outside air to flow into the enclosure;

at least one fan mounted within opposing ends of the enclosure for drawing air in through the plurality of air inlet openings, through a central portion of the enclosure, and through the at least one air outlet opening; and a burner box centrally located within the enclosure between the roof and the floor of the enclosure for heating air the enclosure, the enclosure being configured to allow a service worker to enter an interior thereof to facilitate servicing of the burner box while being protected from any harsh environmental conditions.

17. The air handling apparatus of claim 16, wherein downwardly extending louvers are mounted within the plurality of air inlet openings of the enclosure.

18. The air handling apparatus of claim 16, wherein a duct system is in communication with the at least one air outlet opening to direct air from within the enclosure to a predetermined location.

* * * * *